US009474367B2

(12) United States Patent
Matthai et al.

(10) Patent No.: US 9,474,367 B2
(45) **Date of Patent: *Oct. 25, 2016**

(54) PULL-OUT POWER AND DATA TRAY, WORKSURFACE ASSEMBLY AND METHODS FOR THE USE THEREOF

(71) Applicant: Herman Miller, Inc., Zeeland, MI (US)

(72) Inventors: John Matthai, Holland, MI (US); Leon Ransmeier, New York, NY (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/809,843

(22) Filed: Jul. 27, 2015

(65) Prior Publication Data

US 2015/0327672 A1 Nov. 19, 2015

Related U.S. Application Data

(63) Continuation of application No. 13/913,031, filed on Jun. 7, 2013, now Pat. No. 9,089,209.

(60) Provisional application No. 61/657,165, filed on Jun. 8, 2012.

(51) Int. Cl.

| | |
|---|---|
| ***A47B 37/00*** | (2006.01) |
| ***A47B 21/06*** | (2006.01) |
| ***A47B 21/03*** | (2006.01) |
| ***A47B 21/04*** | (2006.01) |

(52) U.S. Cl.

CPC ..... *A47B 21/06* (2013.01); *A47B 21/03* (2013.01); *A47B 21/0314* (2013.01); *A47B 21/04* (2013.01); *A47B 2021/062* (2013.01); *A47B 2021/066* (2013.01); *A47B 2200/0083* (2013.01)

(58) Field of Classification Search

CPC ..... A47B 13/16; A47B 37/00; A47B 21/00; A47B 21/03; A47B 21/0314; A47B 2021/0321; A47B 2021/0335; A47B 2021/0364

USPC ..... 108/25, 26, 50.01, 50.02, 143; 248/918; 312/223.6, 223.3

See application file for complete search history.

(56) References Cited

U.S. PATENT DOCUMENTS

| | | | | |
|---|---|---|---|---|
| 2,695,831 A | | 11/1954 | Sigal | |
| 2,860,021 A | | 11/1958 | Steele | |
| 3,975,071 A | * | 8/1976 | Quinn | A47B 88/06 108/143 |
| 4,140,355 A | | 2/1979 | Swain | |
| 4,176,889 A | | 12/1979 | Gartung | |

(Continued)

*Primary Examiner* — Jose V Chen

(74) *Attorney, Agent, or Firm* — Michael Best & Friedrich LLP

(57) ABSTRACT

A pull-out tray assembly includes a pull-out tray moveable between a closed position and an open position. A front of the tray moves downwardly and a rear of the tray moves upwardly as the tray is moved from the closed to the open position. Likewise, a front cavity is opened and a rear cavity is closed as the pull-out tray is moved from the closed position to the open position. In one embodiment, the pull-out tray assembly includes a slide mechanism pivotally supporting the pull-out tray at a first location on the tray and a track guiding the tray at a second location on the tray. In various embodiments, at least one of a power outlet and communication port is coupled to the pull-out tray. A worksurface assembly incorporating the pull-out tray is also provided, together with a method of using the pull-out tray.

19 Claims, 6 Drawing Sheets

(56) References Cited

U.S. PATENT DOCUMENTS 4,337,709 A 7/1982 Nicholson
4,379,429 A * 4/1983 Gubbe ..... A47B 21/0314 108/138
4,644,875 A * 2/1987 Watt ..... A47B 21/0314 108/138
4,838,175 A * 6/1989 Hauville ..... B01L 9/02 108/25
4,923,259 A * 5/1990 Bartok ..... A47B 21/0314 108/143
4,931,978 A 6/1990 Drake et al.
5,294,087 A * 3/1994 Drabczyk ..... A47B 21/007 108/138
5,339,213 A * 8/1994 O'Callaghan ..... G06F 3/03547 248/442.2
5,526,756 A 6/1996 Watson
5,595,428 A 1/1997 Huang
5,752,449 A 5/1998 Simon et al.
6,082,838 A 7/2000 Bissu-Palombo
6,099,094 A 8/2000 Lior
6,155,180 A * 12/2000 Clark ..... A47B 21/06 108/26
6,202,568 B1 3/2001 Kochanski et al.
6,241,329 B1 6/2001 Nielsen
6,269,753 B1 * 8/2001 Roddan ..... A47B 21/00 108/50.01
6,431,512 B1 8/2002 Fox et al.
6,454,369 B1 9/2002 Cooper et al.
6,526,895 B1 3/2003 Kochanski et al.
6,626,686 B1 9/2003 D'Souza et al.
6,628,517 B1 9/2003 Helot et al.
6,655,646 B2 12/2003 Johnson
6,895,869 B2 5/2005 Lai
6,996,904 B1 2/2006 Howell
8,127,690 B2 3/2012 Baughman
8,146,514 B2 4/2012 Hamilton et al.
8,172,604 B2 5/2012 Byrne
8,276,523 B2 * 10/2012 Miller ..... A47B 21/00 108/50.02
8,616,136 B2 * 12/2013 Burgess ..... F16M 11/046 108/50.02
9,089,209 B2 * 7/2015 Matthai ..... A47B 21/0314
2003/0181091 A1 9/2003 Zodnik
2004/0070319 A1 * 4/2004 Miller ..... A47B 21/0314 312/208.1
2005/0263042 A1 12/2005 Martin et al.
2007/0247037 A1 * 10/2007 Schenker ..... A47B 88/00 312/223.6
2009/0293773 A1 12/2009 Miller et al.
2010/0026150 A1 * 2/2010 Groeller ..... B60R 11/0205 312/223.6
2010/0096960 A1 * 4/2010 Lee ..... A47B 21/00 312/194
2011/0297051 A1 12/2011 Martin et al.
2013/0206042 A1 * 8/2013 Mohammed ..... A47B 21/007 108/26

* cited by examiner

PULL-OUT POWER AND DATA TRAY, WORKSURFACE ASSEMBLY AND METHODS FOR THE USE THEREOF

CROSS-REFERENCE TO RELATED APPLICATIONS

This application is a continuation of U.S. patent application Ser. No. 13/913,031, filed Jun. 7, 2013, which claims the benefit of U.S. Provisional Application No. 61/657,165, filed Jun. 8, 2012, the entire disclosures of which are hereby incorporated herein by reference.

TECHNICAL FIELD

The present invention relates generally to a pull-out tray, and in particular, to a pull-out tray providing power and/or communication/data access from beneath a worksurface.

BACKGROUND

The use of portable computers, hand-held communication devices, such as smart phones, cell phones, tablets and other similar devices, has become commonplace in the work and home environments. Often, these types of devices are used in multiple locations. While conventional office spaces are often configured with power outlets and data/communication ports in the walls, whether architectural or systems based, open-space work environments configured with free-standing worksurface structures, such as tables, may not afford easy or convenient access to power and data sources. In such environments, power and data supply cords may clutter the top of the worksurface and become easily tangled, thereby impeding the effective and efficient use of the worksurface and detracting from the aesthetics of the workspace. Moreover, in some applications, the worksurface may have multiple functions, functioning as both a desk and dining surface, which may require relocating and removing entirely the cords to satisfy the particular function. As such, a need remains for an improved device capable of providing convenient and controlled access to power and/or data.

SUMMARY

Briefly stated, in one aspect, one embodiment of a pull-out tray assembly includes a pull-out tray having a front and a rear. The pull-out tray is moveable between a closed position and an open position. The front of the tray moves downwardly, and the rear of the tray moves upwardly, as the tray is moved from the closed to the open position. Conversely, the front moves upwardly and the rear moves downwardly as the pull-out tray is moved from the open to closed position.

In another aspect, one embodiment of a worksurface assembly includes a worksurface and a pull-out tray having a front cavity and a rear cavity. The pull-out tray is moveable relative to the worksurface between a closed position and an open position. The front cavity is opened, and the rear cavity is closed, as the pull-out tray is moved from the closed position to the open position. The front cavity is closed and the rear cavity is opened as the pull-out tray is moved from the open to the closed position.

In another aspect, one embodiment of a worksurface assembly includes a worksurface having a front edge, a top surface and a bottom surface. A pull-out tray has a front edge. The pull-out tray is moveable relative to the worksurface from a closed position, wherein the front edge is positioned adjacent the bottom surface of the worksurface, to an open position, wherein the front edge is spaced below the bottom surface. The pull-out tray is configured with at least one of a power outlet and a communication port.

In another aspect, one embodiment of a pull-out tray assembly includes a slide mechanism having a support moveable in a longitudinal direction within a plane. A track forms an acute angle relative to the plane. A pull-out tray is pivotally connected to the support at a first location about a lateral axis. The pull-out tray includes a guide located at a second location longitudinally spaced from the first location, wherein the guide is moveable along the track. At least one of a power outlet and communication port are coupled to the pull-out tray.

In another aspect, one embodiment of a method of providing access to a utility connection from beneath a worksurface includes storing a pull-out tray beneath a worksurface in a closed position. pulling the pull-out tray outwardly from beneath the worksurface to an open position and simultaneously rotating the pull-out tray about a horizontal axis such that a front edge of the pull-out tray is moved outwardly and downwardly relative to an edge of the worksurface. The method further includes providing access to at least one of a power outlet and a communication port in the pull-out tray when the pull-out tray is in the open position.

The various aspects and embodiments provide significant advantages over other worksurface assemblies and pull-out tray assemblies. For example and without limitation, the movement of the pull-out tray between the closed and open positions effectively manages the power supply cord(s), hiding them beneath the worksurface and preventing entanglement thereof. The pull-out tray further brings access to the power outlet and/or communication port into the personal space of the user while preventing cord clutter on top of the worksurface. The discrete configuration and movement of the pull-out tray enables the worksurface to function as both a working desk and dining area. The tray, when in the open position, further provides a shelf to support one or more communication devices, such as a lap top or notebook computer, or tablet device. Conversely, the user may situate such devices on the worksurface on either side of the tray, which provides a convenient power and data source.

The present embodiments of the invention, together with further objects and advantages, will be best understood by reference to the following detailed description taken in conjunction with the accompanying drawings.

DETAILED DESCRIPTION

Figure 1A:
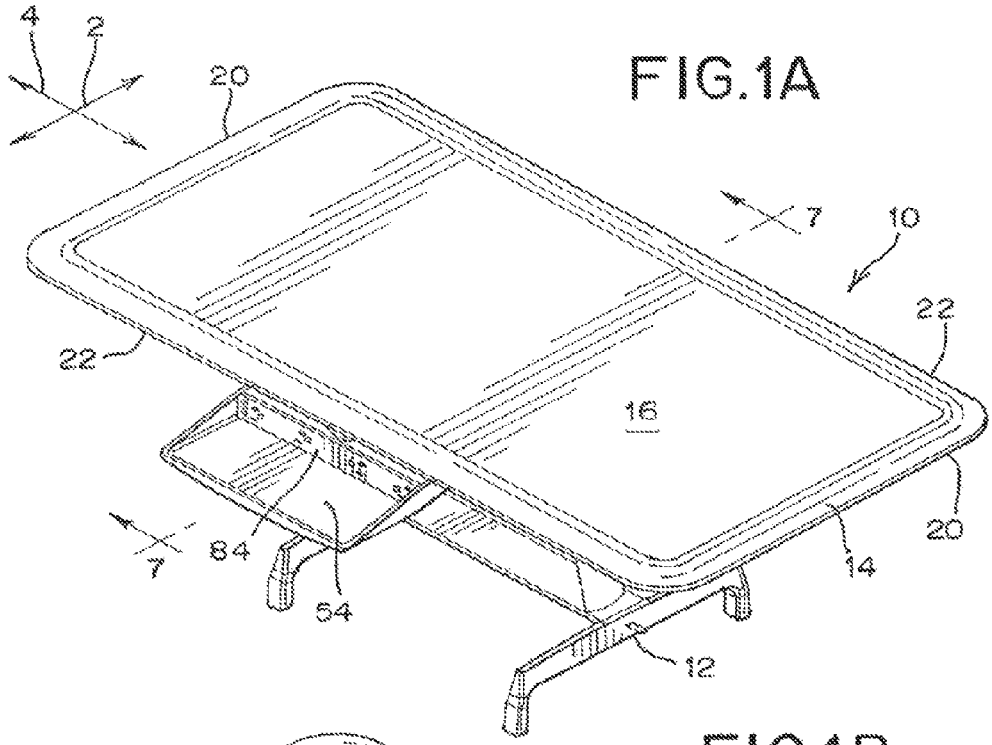
FIGS. 1A and B are perspective views of one embodiment of a worksurface assembly configured with a pull-out tray opened on opposite sides thereof.
Figure 1B:
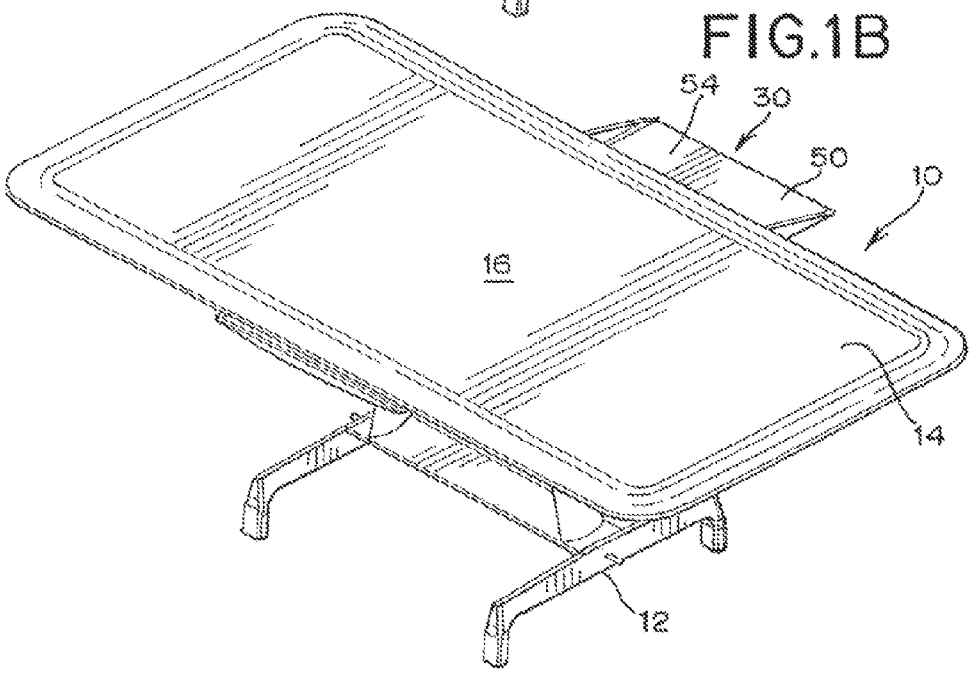
Figure 2:
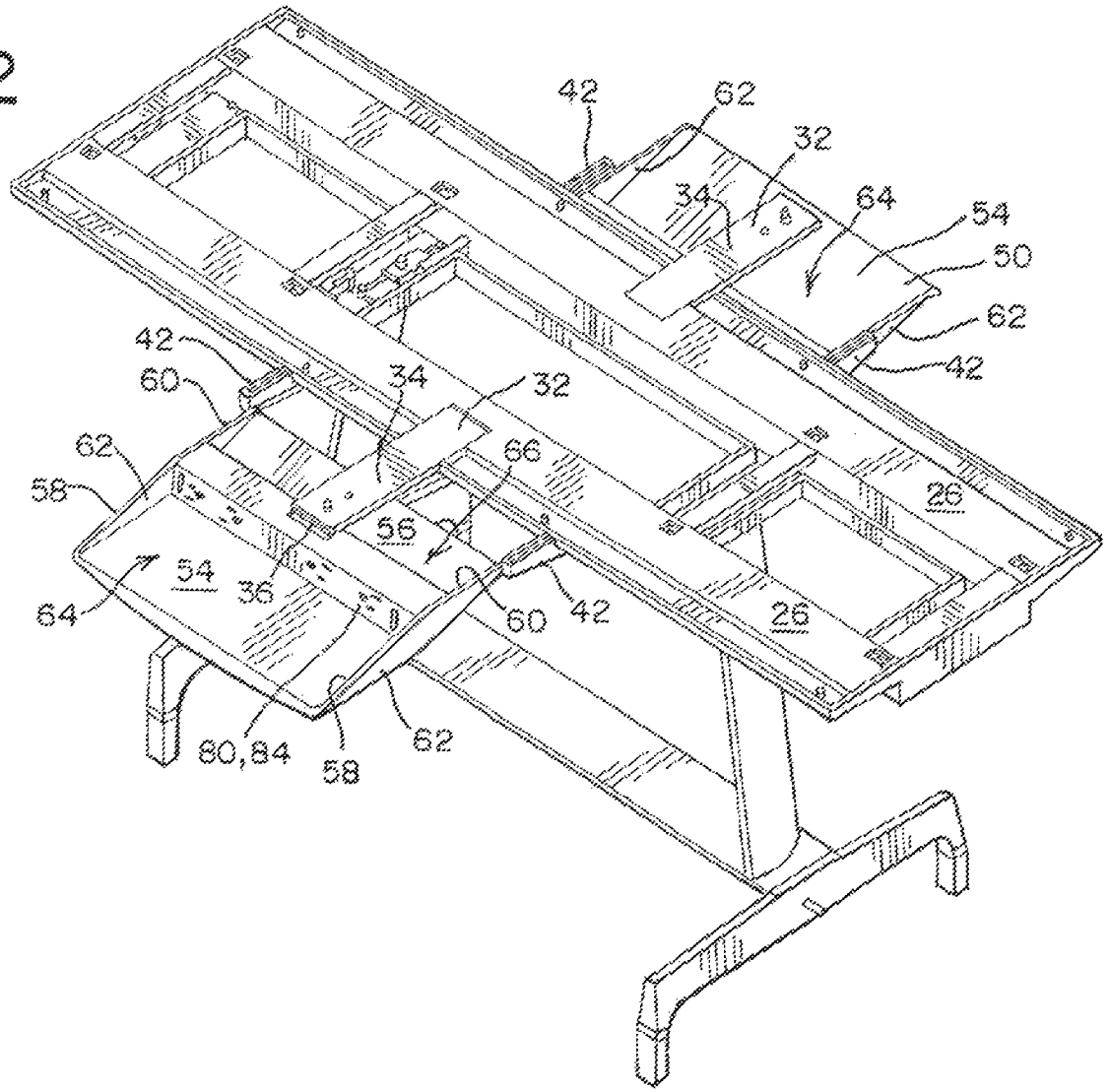
FIG. 2 is a perspective view of a frame supporting a pair of pull-out trays with the worksurface omitted.

The terms "longitudinal" as used herein relates to a length or lengthwise direction 2, including for example generally the direction of movement of the tray relative to the worksurface between a closed and open position. The term "lateral" and variations thereof refer to a sideways direction 4. The terms "top" and "bottom" are intended to indicate directions when viewing the worksurface in a normal operating position. It should be understood that the term "plurality," as used herein, means two or more. The term "coupled" means connected to or engaged with, whether directly or indirectly, for example with an intervening member, and does not require the engagement to be fixed or permanent, although it may be fixed or permanent. The term "transverse" means extending across an axis, including without limitation substantially perpendicular to an axis. It should be understood that the use of numerical terms "first," "second," "third," etc., as used herein does not refer to any particular sequence or order of components; for example "first" and "second" linear paths may refer to any sequence of such paths, and is not limited to the linear paths of a particular configuration unless otherwise specified.

Referring to FIGS. 1A-10, a worksurface assembly 10 includes a base 12 and a worksurface member 14. The worksurface member has a top surface 16, a bottom surface 20, opposite side edges 20 and opposite front edges 22. The base 12 may include a support structure 24, such as a frame, supporting the bottom surface of the worksurface member and a floor engaging structure elevating the worksurface member above the floor. The floor engaging structure may be configured as one or more of a pedestal, a plurality of support legs and feet, or other known and suitable structure, which may be configured in some embodiments with glides or casters. In one embodiment the frame includes a pair of laterally extending beam members 26. A power supply cord (not shown) may be connected to one or more outlets/ports in order to provide power and data communication to a power receptacle 28 mounted to one or both of the beams 26.

A pull-out tray assembly 30 includes a slide mechanism 32. The slide mechanism may be mounted to the support structure 24, or directly to the bottom surface 20 of the worksurface member, or both. The slide mechanism includes in one embodiment a fixed track 34 and a slide 36 moveably supported by the fixed track, for example by way of captured flanges, ball bearings, and other known devices. The slide 36 is moveable along a linear path 38. The slide includes a support 40, configured in one embodiment as a downwardly extending lug. It should be understood that the assembly may be provided with more than one slide mechanism.

The pull-out tray assembly further includes a pair of laterally spaced support brackets 42 coupled to one or both of the support structure and bottom surface of the worksurface member. The support brackets 42 each define a track 44. In one embodiment, the tracks 44 define a linear path 46 and form an acute angle a relative to the linear path of the slide. It should be understood that the assembly may be provided with a single track, ore more than two tracks, as needed.

Figure 4:
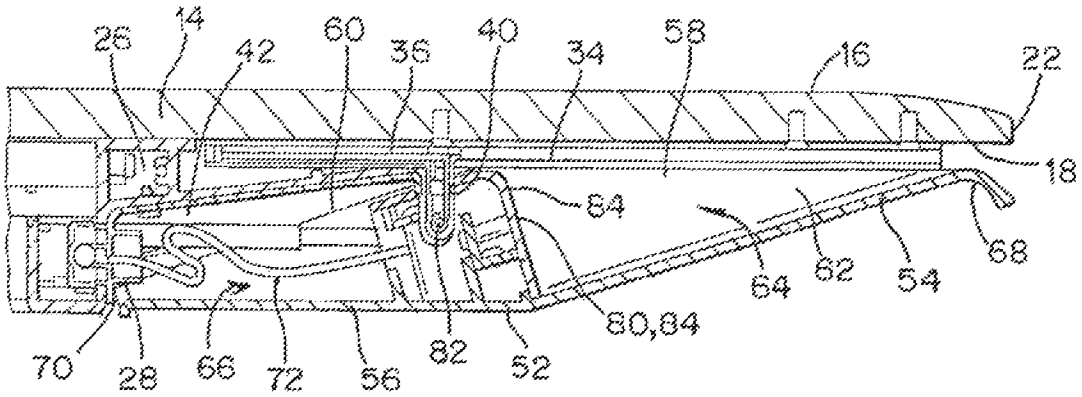
FIG. 4 is a side view of the pull-out tray in a closed position relative to a worksurface.
Figure 5:
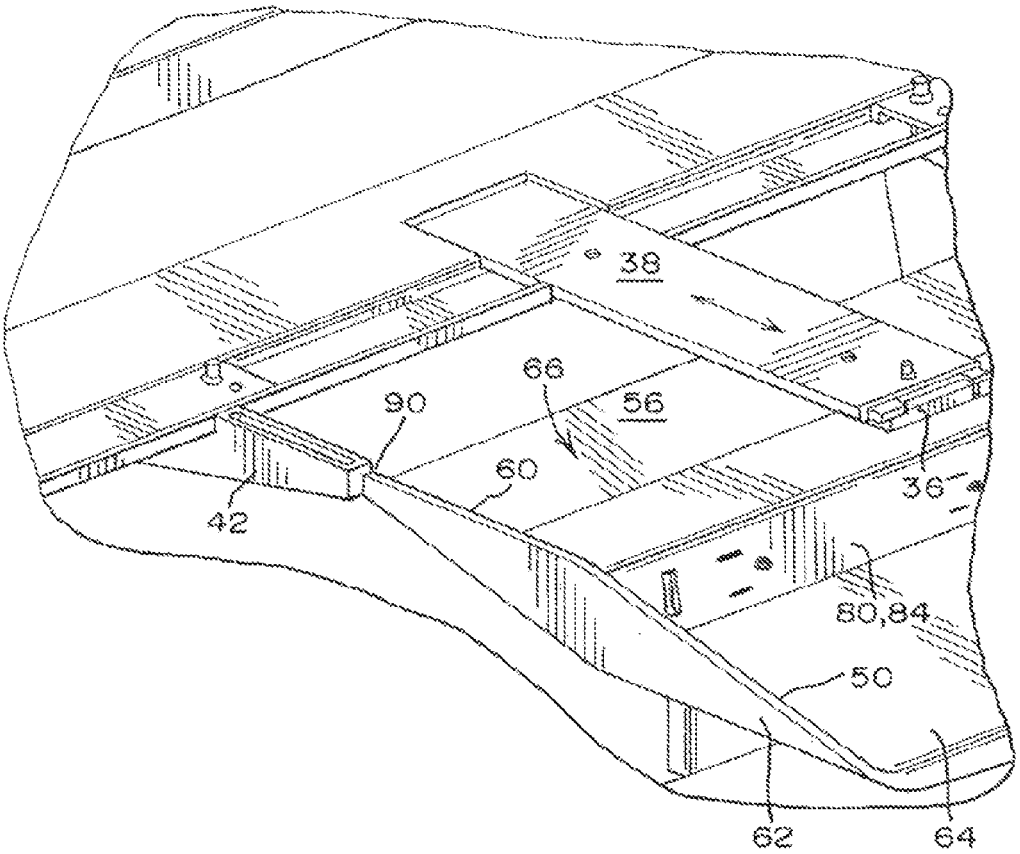
FIG. 5 is a partial, top perspective view of the pull-out tray in an open position.
Figure 6:
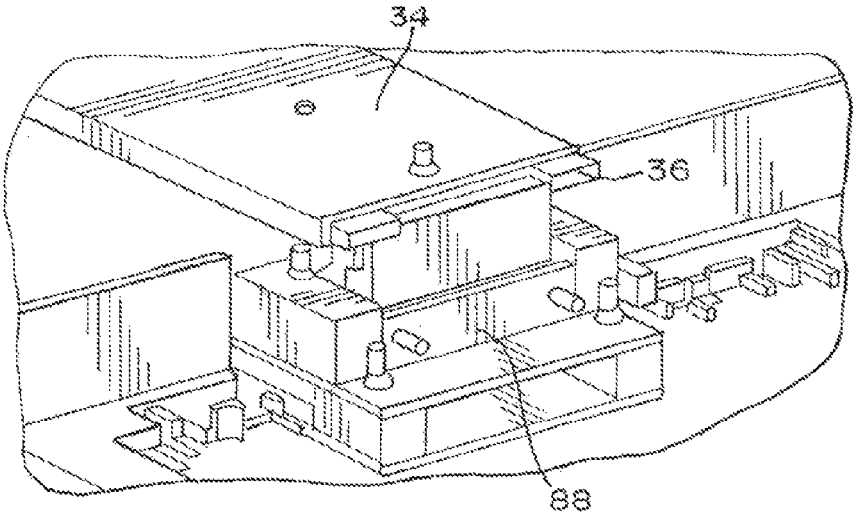
FIG. 6 is an enlarged partial view of the pivot support for the pull-out tray taken along line 6 of FIG. 5.
Figure 7:
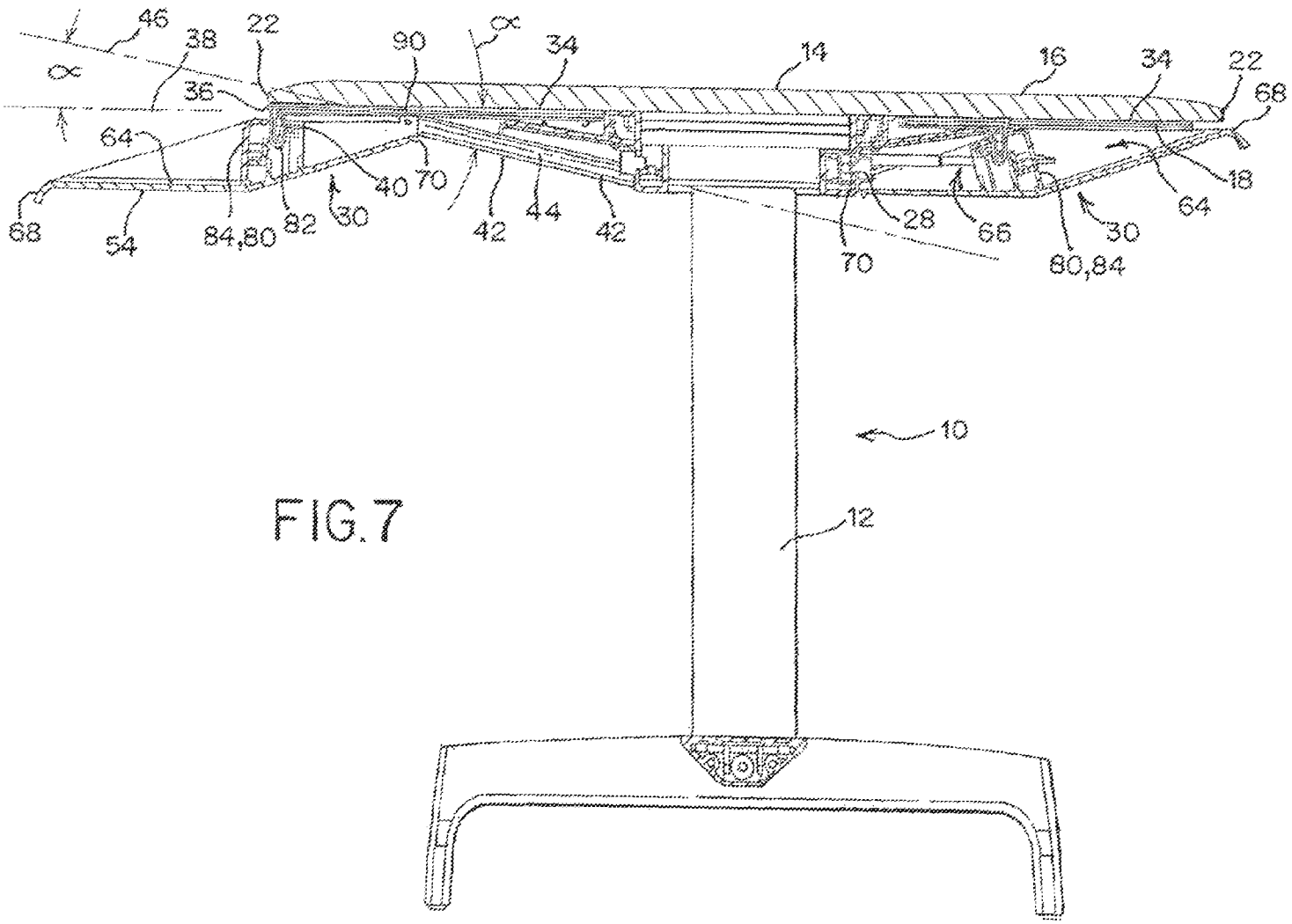
FIG. 7 is a side cross-sectional view of a worksurface assembly with a left side pull-out tray in a closed position and a right side pull-out tray in an open position taken along line 7-7 of FIG. 1.

The pull-out tray assembly further includes a pull-out tray 50 having a bottom wall 52, opposite side walls 62, a front edge 68 and a rear edge 70. The front edge 68 may be configured with a grippable member, such as a downwardly curved flange, which allows the user to grasp and pull/push the pull-out tray between a closed an open position. The bottom wall defines a rear support shelf 56 and a front support shelf 54, with the rear and front support shelves, in combination respectively with the opposite side walls 62 defining front and rear cavities 64, 66 respectively. In one embodiment, the side walls 62 are substantially diamond shaped, with the bottom wall 52 and tops 58, 60 of the side walls 62 forming an angle approximate the acute angle a. In this way, when the pull-out tray is an open position, the front support shelf 54 is substantially horizontal, and when the pull-out tray is in a closed position, the rear support shelf 56 is substantially horizontal as shown in FIG. 7. In addition, the pull-out tray, in combination with the bottom of the worksurface, provides for the front cavity 64 to be substantially closed when the pull-out tray is in a closed position, with the front edge 68 of the pull-out tray being positioned adjacent the bottom surface of the worksurface member. At the same time the rear cavity 66 is substantially open, which facilitates the collection and storage of one or more power cords 72 in the rear cavity as shown in FIG. 4. As the pull-out tray 50 is moved to an open position, the front edge 68 drops relative to, and is spaced below, the bottom surface 18 of the worksurface member, and is spaced in front of the front edge 22 of the worksurface member, so as to provide access to the front cavity 64.

One or more power outlets and communication ports 80, including for example a three pronged outlet, USB port, cable port, etc., are coupled to the pull-out tray 50. The outlets/ports 80 may be configured as modules coupled together to form a power/data/communication center 84. It should be understood that the center 84 may be configured with only a single power outlet, only a single data/communication port, pluralities of those components, or combinations thereof.

In one embodiment, the outlets/ports 80 or center 84 may be connected to the pull-out tray 50 proximate the junction between the front and rear shelves 52, 56 and adjacent the pivot axis 82, with the power/data/communication center 84 providing a separation between the front and rear cavities 64, 66. By virtue of the center being positioned adjacent the pivot axis 82, the center 84 is maintained substantially adjacent the bottom surface 18 of the worksurface member. As the pull out tray is rotated, a face 84 of the station also rotates and is substantially perpendicular to the front support shelf 54, thereby providing a rear wall for the front cavity 64 when the pull-out tray is in the open position, and a front wall for the rear cavity 66. The power supply cord 72, defined as providing both power and data transmission, is coupled between at least one of the outlet/ports/center and the power receptacle 28. The power supply cord 72 is of sufficient length that it extends between the outlet/ports/center and the receptacle 28 module when the pull-out tray is in open position. The front cavity can be used to hold various accessories, one or more communication devices or other components.

The pull-out tray 50 includes a support 88 positioned at a first location, configured in one embodiment as including a pin, that is pivotally connected to the slide support about a laterally extending horizontal axis 82. In addition, the pull-out tray includes a pair of guides 90 positioned at a second location longitudinally spaced from the first location, configured in one embodiment as rollers, secured to the opposite side walls 62 adjacent the rear edge 70 of the pull-out tray. The guides 90 are supported by and move along the tracks 44.

Figure 3:
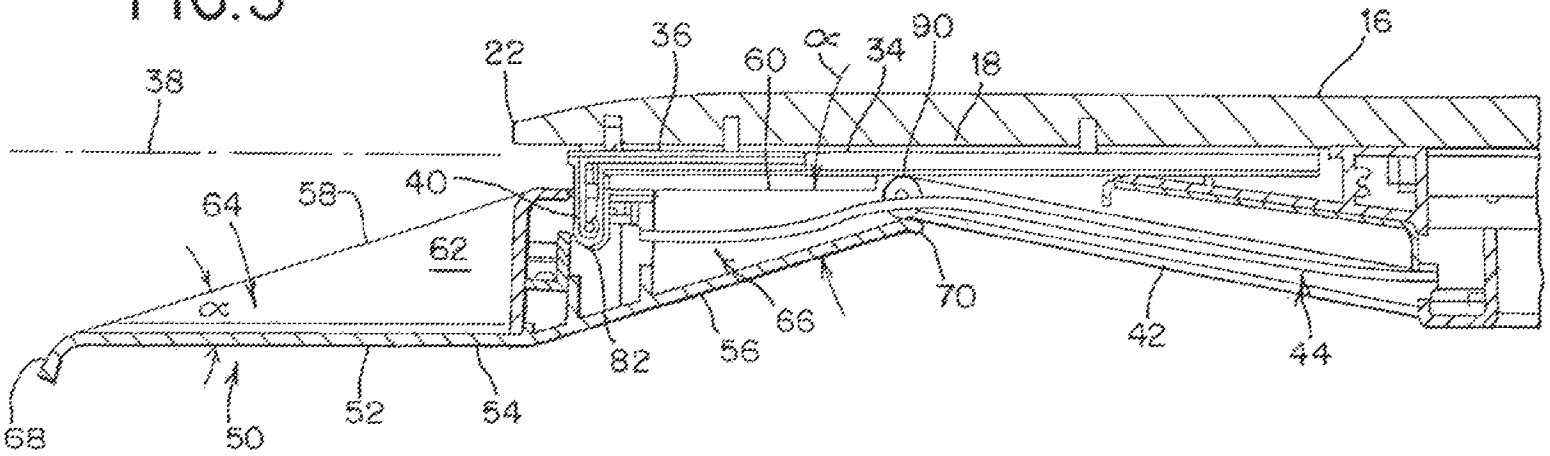
FIG. 3 is a side view of the pull-out tray in an open position relative to a worksurface.

In operation, when access to one or more of the front cavity 64 or power outlet/data port/center 80, 84 is desired, the user 96 grasps the front edge 68 of the pull-out tray 50 and pulls the pull-out tray from a closed position (FIG. 4) outwardly from beneath the worksurface to an open position (FIG. 3). As the user pulls the pull-out tray outwardly, the pull-out tray 50 translates along the linear path 38 and rotates about the horizontal axis 82 such that the front edge 68 of the pull-out tray is moved outwardly and downwardly relative to the worksurface member, including the front edge 22 and bottom surface 18. As such, the front cavity 64 is moved from a closed configuration, wherein the front edge 68 is positioned adjacent the bottom surface 18, to an open configuration, wherein the user is provided access to the cavity 64 and/or at least one of the power outlet and communication port 80 or center 84, and the rear cavity 66 is moved from an open position, wherein the rear edge 70 is positioned adjacent the bottom surface 18, to a closed position. It should be understood that even in the closed configuration, there is sufficient space between the rear edge 70 and the bottom surface 18 of the worksurface member for passage of the power supply cord 72. When the pull-out tray is no longer needed, the user pushes the pull-out tray 50 inwardly, with the front edge 68 of the tray rotating upwardly due to the interplay between the pivot 82 and guides/track 90, 44, such that the front edge 68 is disposed adjacent the bottom surface 18 of the worksurface member and the front cavity 64 is closed.

At the same time, the rear edge 70 drops or moves downwardly relative to the bottom surface 18 with the rear cavity 66 opening, thereby providing space for the power cord 72 to be collected and stored.

Figure 9:
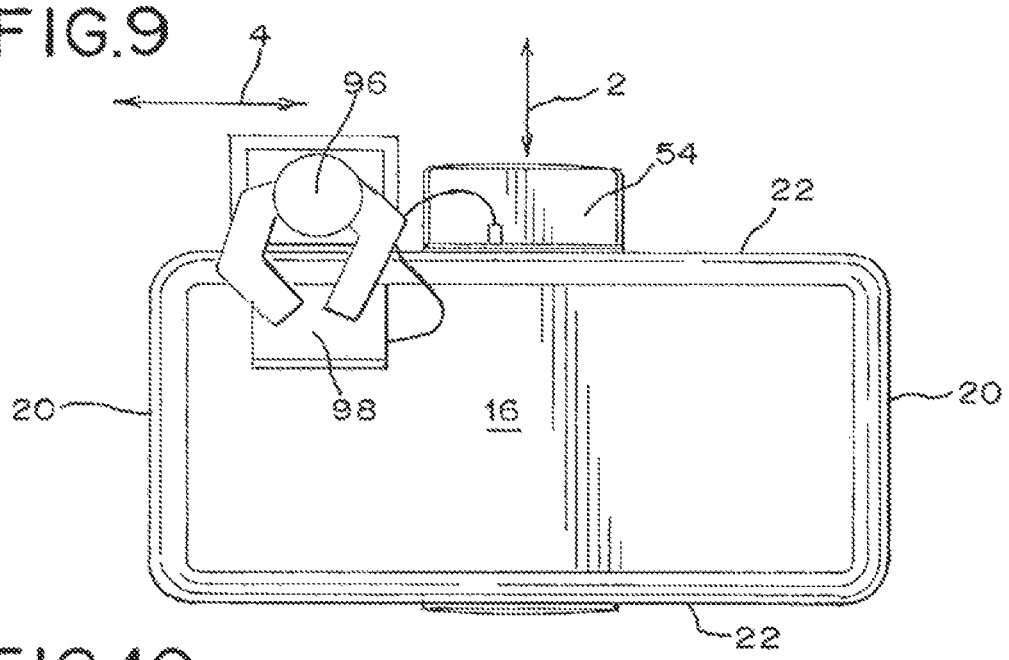
FIG. 9 is a top view of the worksurface assembly shown in FIG. 1.
Figure 10:
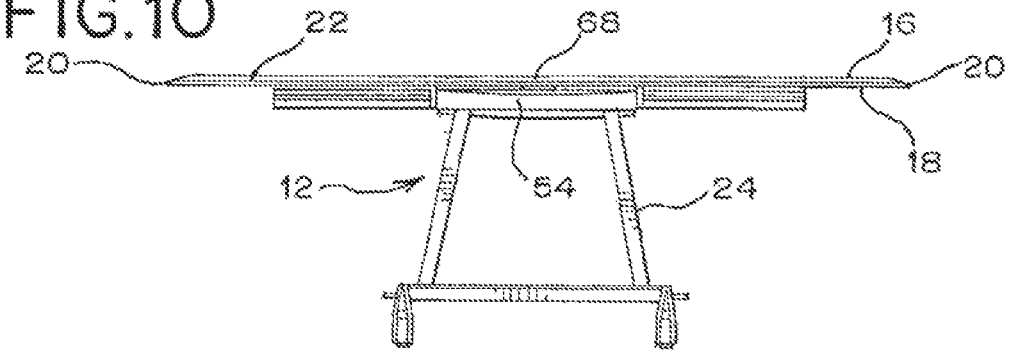
FIG. 10 is a front view of the worksurface assembly shown in FIG. 1.
Figure 8:
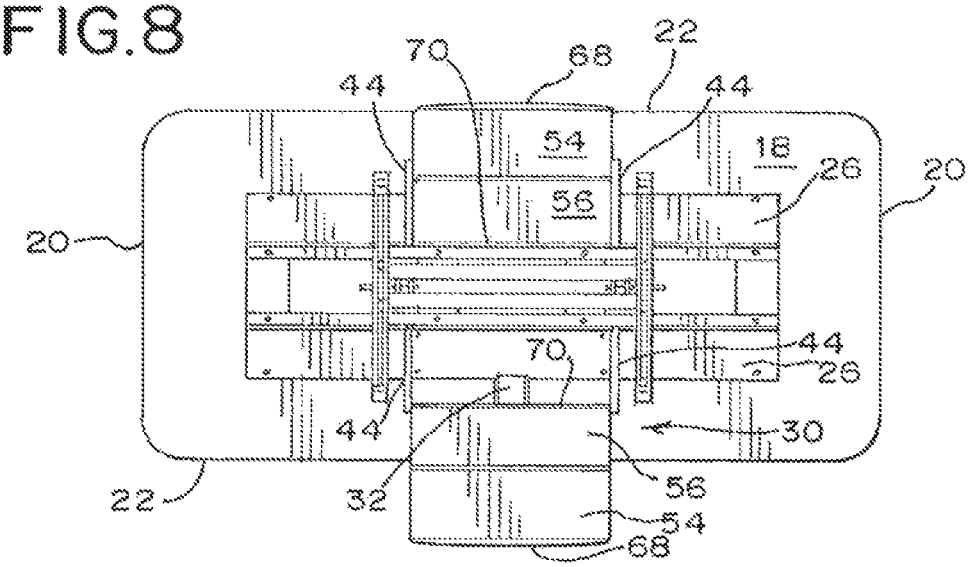
FIG. 8 is a bottom view of the worksurface assembly shown in FIG. 1.

The movement of the pull-out tray between the closed and open positions effectively manages the power supply cord(s) 72, hiding them beneath the worksurface member 14 and preventing entanglement thereof. The pull-out tray 50 further brings access to the power outlet/communication port/center into the personal space of the user 96 as shown in FIG. 9, while preventing cord clutter on top of the worksurface. The discrete configuration and movement of the pull-out tray enables the worksurface to function as both a working desk and dining area. The pull-out tray, when in the open position, further positions the front support shelf 54 to support one or more communication devices, such as a lap top or notebook computer 98, or tablet device, or to hold other necessary accessories and tools. Conversely, the user may situate such devices 98 on the worksurface member on either side of the tray as shown in FIG. 9, which provides a convenient power and data source. In this embodiment, a pull-out tray assembly is centered along the opposite front edges of the worksurface member. It should be understood that a single assembly may be used, or that one or more assemblies may be arranged along the side edges 20, or that the assemblies may not be centered, but rather may be offset from a centerline on one side or the other along the front edge.

The pull-out tray also acts as a "clamshell" when moved to the closed position, such that cables and cords disposed in a front cavity, for example connected to a computer or user interface, do not become entangled or trapped between the front edge 22 of the worksurface member the front edge 68 of the pull-out tray, as may happen with a conventional drawer, which may require the user to stuff the cords into the drawer. The "clamshell" closing action utilizes the worksurface member 14 as a lid for the front cavity 64, without trapping the cords. In this way, the user may still use the power/data supply from the power/data supply source/center in the pull-out tray, even when the pull-out tray is in the closed position, for example when the user is seated immediately in front of the pull-out tray 50. It should be understood that the front edge 68 of the pull-out tray is deemed to be adjacent the bottom surface 18 of the worksurface member 14 even if a small gap is maintained in the closed position (see FIG. 4) to allow for the passage of cables and cords, which can be accumulated and stored in the closed front cavity.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A method of providing access to a utility connection from beneath a worksurface, the method comprising:

storing a pull-out tray beneath the worksurface in a closed position with the front edge of the pull-out tray adjacent a bottom surface of the worksurface;

pulling the pull-out tray outwardly from beneath the worksurface to an open position and simultaneously rotating the pull-out tray about a horizontal axis such that a front edge of the pull-out tray is moved outwardly and downwardly relative to an edge of the worksurface; and providing access to at least one of a power outlet and a communication port in the pull-out tray when the pull-out tray is in the open position.

2. The method of claim 1, wherein pulling the pull-out tray outwardly comprises pulling a power supply cord connected to the at least one of the power outlet and the communication port.

3. The method of claim 1, wherein storing the pull-out tray in the closed position comprises storing the power supply cord in a cavity defined by the pull-out tray.

4. The method of claim 1, wherein the pull-out tray comprises a front support shelf disposed in front of the at least one of the power outlet and the communication port.

5. The method of claim 4, wherein the front support shelf defines a front storage cavity.

6. The method of claim 4, wherein the front support shelf is substantially horizontal when the pull-out tray is in the open position, and wherein the front support shelf forms an acute angle relative to a horizontal plane when the pull-out tray is in the closed position.

7. The method of claim 1, wherein pulling the pull-out tray outwardly from beneath the worksurface to the open position comprises supporting the pull-out tray at a first support location, translating the first support location outwardly within a plane, and pivoting the pull-out tray about the first support location.

8. The method of claim 7, wherein pulling the pull-out tray outwardly further comprises supporting the pull-out tray at a second support location spaced rearwardly from the first support location, and guiding the second support location upwardly and outwardly.

9. The method of claim 1, wherein the pull-out tray comprises a front support shelf disposed in front of the at least one of the power outlet and the communication port, and wherein the front support shelf is oblique to the worksurface in the closed position.

10. A method of providing access to a utility connection from beneath a worksurface, the method comprising:

storing a pull-out tray beneath the worksurface in a closed position so that a front support shelf of the pull-out tray is oblique to the worksurface;

moving the pull-out tray away from the worksurface to an open position so that the front support shelf of the pull-out tray is substantially parallel to the worksurface; and providing access to at least one of a power outlet and a communication port in the pull-out tray when the pull-out tray is in the open position.

11. The method of claim 10, wherein the front support shelf defines a front storage cavity in front of the at least one of a power outlet and a communication port.

12. The method of claim 10, wherein, when in the closed position, a rear support shelf of the pull-out tray is substantially parallel to the worksurface, and wherein, when in the open position, the rear support shelf of the pull-out tray is substantially oblique to the worksurface.

13. The method of claim 12, wherein the rear support shelf defines a rear storage cavity behind the at least one of a power outlet and a communication port.

14. The method of claim 10, wherein the pull-out tray simultaneously rotates about a horizontal axis when moving from the closed position to the open position so that a front edge of the front support shelf is moved outwardly and downwardly relative to an edge of the worksurface.

15. A method of providing access to a utility connection from beneath a worksurface, the method comprising:

storing a pull-out tray beneath a worksurface in a closed position so that a front edge of the pull-out tray is positioned adjacent a bottom surface of the workstation;

moving the pull-out tray from beneath the worksurface to an open position along a track oriented at an oblique angle relative to the worksurface so that the front edge of the pull-out tray is spaced below the bottom surface of the workstation; and providing access to at least one of a power outlet and a communication port in the pull-out tray when the pull-out tray is in the open position.

16. The method of claim 15, wherein the pull-out tray comprises a front support shelf disposed in front of the at least one of the power outlet and the communication port.

17. The method of claim 16, wherein the front support shelf defines a front storage cavity.

18. The method of claim 16, wherein the front support shelf is substantially horizontal when the pull-out tray is in the open position, and wherein the front support shelf forms an acute angle relative to a horizontal plane when the pull-out tray is in the closed position.

19. The method of claim 15, wherein the pull-out tray simultaneously rotates about a horizontal axis when moving from the closed position to the open position so that the front edge of the front support shelf is moved outwardly and downwardly relative to an edge of the worksurface.

* * * * *